US007503599B2

(12) United States Patent
Ward

(10) Patent No.: US 7,503,599 B2
(45) Date of Patent: Mar. 17, 2009

(54) RESIDENTIAL ELECTRIC DOOR STRIKE

(76) Inventor: Jeffrey H. Ward, P.O. Box 49, South Haven, MI (US) 49090

( * ) Notice: Subject to any disclaimer, the term of this patent is extended or adjusted under 35 U.S.C. 154(b) by 0 days.

(21) Appl. No.: 11/083,141

(22) Filed: Mar. 17, 2005

(65) Prior Publication Data

US 2005/0161960 A1 Jul. 28, 2005

Related U.S. Application Data

(62) Division of application No. 10/335,622, filed on Jan. 2, 2003, now Pat. No. 6,886,305.

(60) Provisional application No. 60/346,087, filed on Jan. 3, 2002.

(51) Int. Cl.
*E05B 15/02* (2006.01)

(52) U.S. Cl. ..... 292/341.16; 292/341.15

(58) Field of Classification Search ..... 292/341.16, 292/341.15, 340, DIG. 53; 70/466; 52/204.1
See application file for complete search history.

(56) References Cited

U.S. PATENT DOCUMENTS 1,852,854 A * 4/1932 Norring ..... 292/341.19
3,521,921 A 7/1970 Miyazaki
3,704,460 A 11/1972 Frank
3,774,422 A 11/1973 Hogan et al.
3,804,442 A * 4/1974 Powers ..... 292/341.16
3,819,215 A 6/1974 Fuss
4,056,276 A 11/1977 Jarvis
RE30,263 E 4/1980 Horvath
4,458,774 A * 7/1984 Sieren ..... 180/69.2
4,470,625 A * 9/1984 Walsh et al. ..... 292/201
4,550,939 A 11/1985 Babb et al.
4,565,228 A 1/1986 Ponce
4,652,862 A 3/1987 Verslyken
4,815,215 A 3/1989 Saylor et al.
5,035,450 A * 7/1991 Muller ..... 292/92
5,076,625 A 12/1991 Oxley
5,118,151 A 6/1992 Nicholas et al.
5,219,196 A 6/1993 Luker
5,279,343 A 1/1994 Woods
5,437,174 A 8/1995 Aydin
5,490,698 A 2/1996 Dezso
5,511,832 A 4/1996 Künzel
5,511,839 A 4/1996 Fuss et al.
5,729,198 A 3/1998 Gorman (Continued)

OTHER PUBLICATIONS

Filed PTO-1449 from U.S. Appl. No. 10/335,622 (parent case).

*Primary Examiner*—Gary Estremsky
(74) *Attorney, Agent, or Firm*—Fraser Clemens Martin & Miller LLC; William J. Clemens

(57) ABSTRACT

An electric door strike for installation in residential wood frame door frames permits "hands-free" home access. An installation jig used to form an aperture in the door frame and a cavity in the underlying stud in which the door strike is mounted. A remote control circuit transmitter actuates the door strike to an unlatched position and a time delay circuit returns the door strike to a latched position after a predetermined delay time period. The transmitter can be used to interrupt the predetermined delay time period and immediately return the door strike to the latched position.

13 Claims, 10 Drawing Sheets

U.S. PATENT DOCUMENTS 5,735,559 A 4/1998 Frolov
5,762,115 A 6/1998 Shouse
D401,565 S 11/1998 Smith et al.
5,850,753 A * 12/1998 Varma ..... 70/278.7
5,852,944 A 12/1998 Collard, Jr. et al.
5,934,720 A * 8/1999 Karalius ..... 292/341.16
5,987,818 A 11/1999 Dabideen
5,990,579 A 11/1999 Ricci
6,005,306 A * 12/1999 Pickard ..... 307/117
6,043,753 A 3/2000 Okayasu et al.
6,112,471 A * 9/2000 Welch et al. ..... 49/503
6,299,225 B1 * 10/2001 Chang ..... 292/341.16
6,318,138 B1 11/2001 Mathews et al.
6,325,429 B1 * 12/2001 Oxley ..... 292/341.16
6,454,324 B1 9/2002 Lewis et al.
6,560,934 B1 * 5/2003 Workman ..... 52/126.1

* cited by examiner

RESIDENTIAL ELECTRIC DOOR STRIKE

CROSS-REFERENCE TO RELATED APPLICATION

This application is a divisional of the U.S. patent application Ser. No. 10/335,622 filed Jan. 2, 2003, now U.S. Pat. No. 6,886,305 which claims the benefit of U.S. provisional patent application Ser. No. 60/346,087 filed Jan. 3, 2002.

BACKGROUND OF THE INVENTION

The present invention relates generally to electric door strikes and, in particular, to an electric door strike for use in residential buildings.

With regard to "electric door strike" prior art, the earliest reference found to this type of device is the U.S. Pat. No. 277,628 to Sullivan in May of 1883. Sullivan's patent claims to be an "improvement in electric locks", indicating that the electric door strike is even older than that. As you might expect from a device of this age, there are literally hundreds of patents on file promoting changes and improvements of every type.

Nearly all prior art patents utilize a "surface mount" design. Only two exceptions were found. The U.S. Pat. No. 4,056,276 to Jarvis describes a latch and strike arrangement, of which the strike is supported via a bored hole in the door frame. The U.S. Pat. No. 5,729,198 to Gorman (mentioned below) describes a solenoid mounted in a tube extending back into the door frame. With these two exceptions notwithstanding, the mounting arrangement according to the present invention and described in this patent application is unique.

With regard to router jigs, router and guide structures of various types have been used for many years to provide guidance of routers and their use in wood working procedures. Such apparatus may be found for example in the U.S. Pat. No. 4,825,920 to Evitts wherein a router structure utilizes a slotted guide plate mounted to a support base for mounting a router thereto.

The U.S. Pat. No. 3,985,168 to Lundquist shows an adjustable router table of rectangular configuration, wherein each of the legs is adjustable relative to one another.

The U.S. Pat. No. 4,630,657 to Obradovich shows a router guide structure utilizing opposed clamping members to secure a workpiece and router structure thereof.

The U.S. Pat. No. 4,552,193 to Armas describes a door frame shaper mounting a router thereto in a guide orientation for shaping door frames in predetermined patterns.

The U.S. Pat. No. 2,862,302 to Lucia describes an adhesive backed "paper-like" template designed to assist an installer in locating boring holes associated with strike installation.

Although each of the above patents provides for a specific need, no prior art has been found that addresses the need to provide fast mounting of an electric strike.

The advent of 'keyless entry' in the automotive world has created an interest in developing a similar product for the residential home market. Early efforts included remote controlled deadbolts (as shown in the U.S. Pat. No. D401,565 to Smith), and remote controlled locksets (as described in the U.S. Pat. No. 5,437,174 to Aydin). Though simple and inexpensive, these 'do-it-yourself' products were cheaply made and utilized battery power. Their success was short lived.

The U.S. Pat. No. 5,729,198 shows a wireless residential door unlatch system having solenoid/strike plate assembly controlled by a receiver unit which in turn is controlled by RF or other signals. The system can be retrofit into existing residential structures with a single bore into the door jam into which the solenoid/strike plate assembly is mounted. The U.S. Pat. No. 5,729,198 is incorporated herein by reference.

The U.S. Pat. No. 6,005,306 shows a remote control door lock system for residential and commercial building pedestrian doors. The system includes an electrically powered striker plate assembly having a striker plate member moveable between positions for engagement and disengagement with a door latch member. The striker assembly is adapted to be connected to a control unit which supplies low voltage DC power to the striker assembly and includes a radio frequency range signal receiver and a circuit responsive to receiving signals from an operator controlled radio transmitter to effect indefinite or momentary operation of the striker assembly to unlock a door. The control unit circuit includes a first self-latching relay, a selector switch and a second relay for selecting an operating mode of the system wherein the door may be unlatched momentarily (for about 3.5 seconds, for example) or indefinitely until a second signal is transmitted by the transmitter to the receiver. This arrangement has three drawbacks:

1. Many electric strikes are equipped with "intermittent duty" solenoids or magnetic coils (as opposed to "continuous duty"). These coils are made to exert maximum magnetic force, at the expense of heat buildup in the coil. They are limited to 90 seconds of operation in the energized position. If energized longer than 90 seconds they will burn up. The option to leave the striker in the energized position for extended periods as described in U.S. Pat. No. 6,005,306 could result in considerable maintenance to the striker mechanisms.
2. Since users may forget if they locked the door behind them, there should be a position indication of some type near the door (a light, or buzzer to indicate that the door is not locked). The design outlined in U.S. Pat. No. 6,005,306 has no provision for indication. Other than physically 'trying' the door, the user has no way to tell if the striker is in the latched or unlatched position.
3. U.S. Pat. No. 6,005,306 provides a maximum of 3.5 seconds of delay in the "momentary" mode. If the user is entering the house with an armload of groceries, it might be good to have more time than that.

SUMMARY OF THE INVENTION

The present invention concerns an apparatus and a method for constructing, installing, and remotely and automatically controlling an electric door strike. The present invention provides the following improvements over the conventional electric door strike design: 1) a shim adjustment; 2) a splice box accessible after the lock is installed; 3) simplified keeper using a solenoid plunger; and 4) striker body mounts by bolting through the underlying wood frame. There is quick installation of the strike by using a jig and router.

The apparatus according to the present invention concerns an electric door strike for use in with an inwardly opening door including: a striker body for mounting in an aperture formed in a door frame and a cavity formed in an underlying stud; a keeper device mounted in the striker body, the keeper device including a keeper biased by a return spring to a door latched position, the keeper being selectively movable to a door unlatched position against a biasing force applied by the return spring; a solenoid device mounted in the striker body, the solenoid device having a plunger normally blocking the keeper and preventing movement of the keeper from the door latched position, the solenoid being selectively operable for moving the plunger away from the keeper thereby permitting movement of the keeper to the door unlatched position; and a remote radio signal transmitter and associated receiver, the receiver being included in a control circuit mounted in the striker body and connected to the solenoid device, the receiver being responsive to operation of the transmitter to cause the control circuit to actuate the solenoid device to move the plunger away from the keeper.

The method of installing and controlling an electric door strike comprises the steps of: a) providing a striker body having a keeper movable between a door latched position and a door unlatched position and a solenoid device mounted therein maintaining the keeper in the door latched position; b) attaching a jig to a door frame of an inwardly opening door; c) operating a tool to form an aperture in the door frame and a cavity in an underlying stud; and d) installing the striker body in the door frame aperture and the stud cavity. The method also includes providing a remote control transmitter and receiver set, installing the receiver in the striker body, connecting the receiver to the solenoid device, and operating the transmitter in a first mode to cause the receiver to energize the solenoid device and release the keeper for movement to a door unlatched position. The method further includes providing a timer circuit to energize the solenoid device for a predetermined delay time period whereupon the solenoid device automatically returns the keeper to the door latched position at an expiration of the predetermined delay time period and wherein the predetermined delay time period can be approximately 90 seconds.

The method includes operating the transmitter in a second mode during the predetermined delay time period to interrupt the predetermined delay time period and cause the solenoid device to automatically return the keeper to the door latched position. A key-fob transmitter can be provided as the remote control transmitter, actuating a first button on the key-fob transmitter to operate the transmitter in the first mode and actuating a second button on the key-fob transmitter to operate the transmitter in the second mode.

The step c. can be performed by guiding a router with said jig to form a generally rectangular aperture open at one side in the door frame and to form a generally rectangular cavity open at one side in the stud. The method includes providing a splice box in the striker body and making the splice box accessible for performing wiring connections after the striker body has been mounted in the door frame aperture and the stud cavity. The method also includes visually indicating the energized and non-energized states of the solenoid device.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
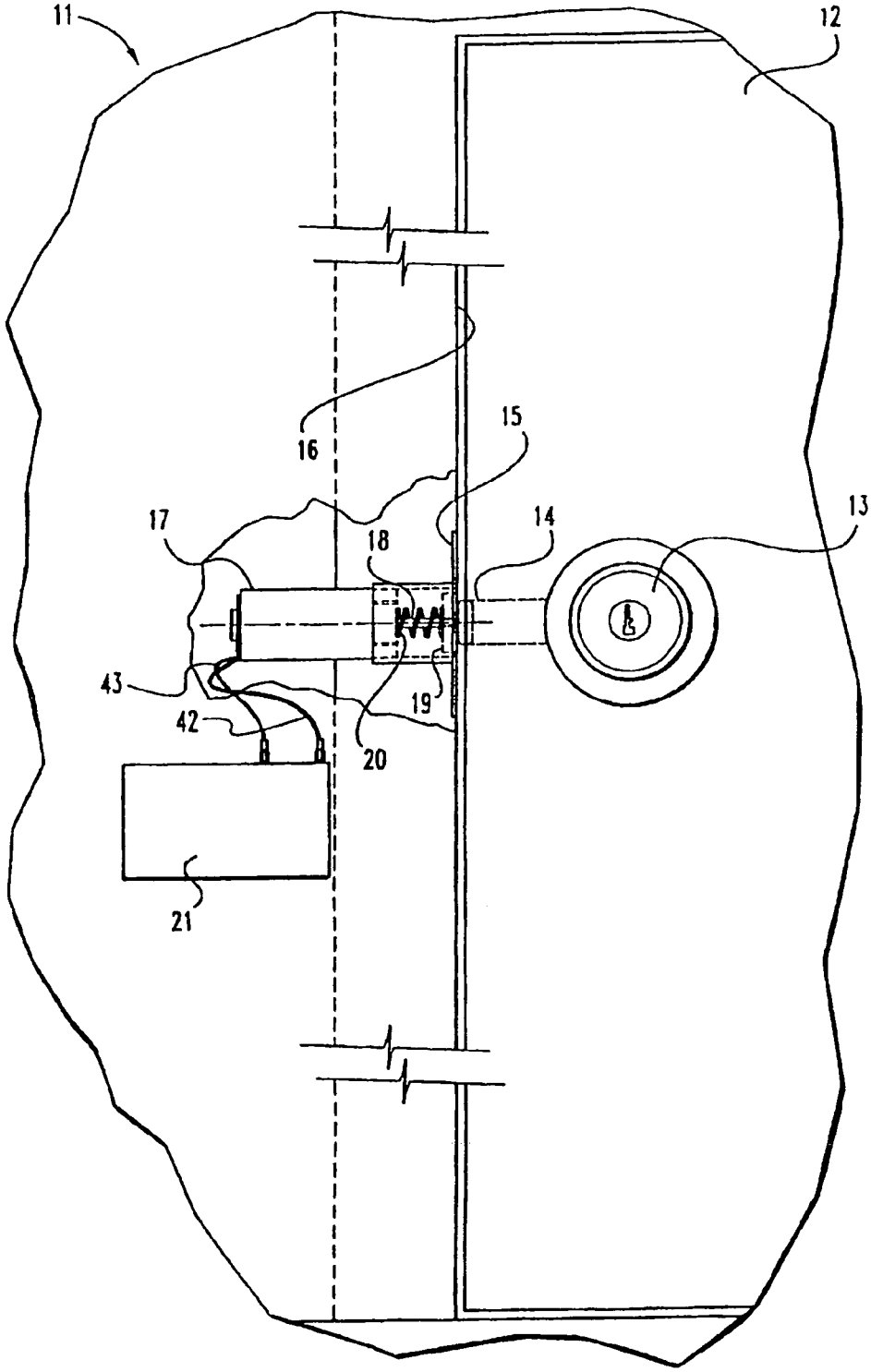
FIG. 1 (PRIOR ART)
FIG. 1 is a perspective, cutaway view of a prior art wireless door unlatch system.

FIG. 1, taken from the U.S. Pat. No. 5,729,198 incorporated herein by reference, shows a prior art wireless door unlatch system 11 including a door 12 of a building having a door handle 13. The door handle 13 is operatively associated with a latch 14, which is spring biased to an extended position for securing the door in its latched, closed position. Rotation of the handle 13 overcomes the spring bias of the latch 14, thus retracting the latch, unlatching the door 12 and allowing the same to be pivoted to an open position. In this regard, the latch 14 cooperates with a strike plate 15 mounted in a doorjamb 16 for latching and unlatching operations. In particular, in a latched position, the latch 14 extends into an opening of the strike plate 15, thus securing the door 12 against pivoting from its closed position. On the other hand, when the latch 14 is in a retracted position, it clears the opening of the strike plate 15 such that the door 12 can be pivoted open.

The system 11 also includes a solenoid/strike plate assembly 17 having a solenoid with a push rod 18. Attached to an end of the push rod 18, via threads or the like, is an engagement plate 19, preferably circular in cross section. The assembly 17 also includes a spring 20 mounted over the rod 18 in between the body of the solenoid and the engagement plate 19. The spring 20 assists in the overall smooth operation of the assembly, and can assist the solenoid in forcing the latch 14 to its retracted position.

The system 11 further includes a control box 21 which can, for example, be mounted on an interior wall of the residence, adjacent the door 12. The control box 21 includes electronics which, in conjunction with a transmitter, control the energization/de-energization of the solenoid via leads 42 and 43.

Figure 2:
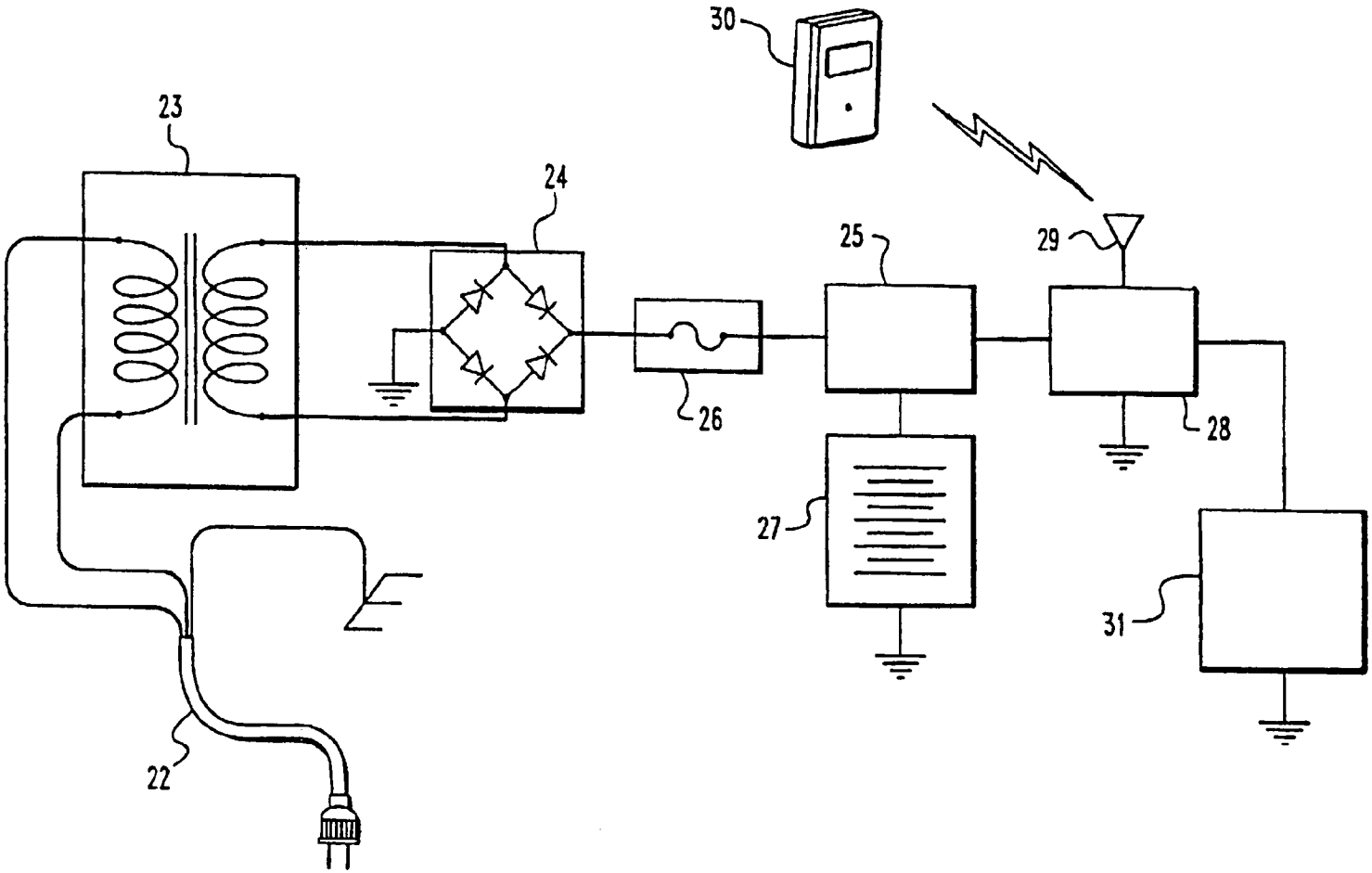
FIG. 2 (PRIOR ART)
FIG. 2 is schematic circuit diagram of the system shown in FIG. 1.

FIG. 2, taken from the U.S. Pat. No. 5,729,198, is a schematic circuit diagram of illustrative electronics contained in the control box 21 shown in FIG. 1. A standard three-prong cord 22 is operatively coupled to a step-down transformer 23 with an output voltage of about sixteen volts. The output of the transformer 23 is operatively coupled to a full wave rectifier 24 having an output of about twelve volts. The full wave-rectified DC output from the rectifier 24 is operatively coupled to a charger circuit 25 with an intervening fuse 26. The charger circuit 25 is operable to charge a backup battery 27. After the charger circuit 25, the twelve volt full wave-rectified supply is operatively coupled to receive an RF signal from a wireless remote transmitter 30 and during the period over which the signal is being received, to energize a solenoid 31. In this manner, the system 11 will unlatch the door 12 such that the user can push the door open without the need to turn the handle 13. It should be noted in this regard that the remote signal from the transmitter 30 will unlatch the door 12 regardless of whether the door is in a locked or unlocked position, as in spring latched devices commonly used today, the latch 14 can be pushed to its retracted position regardless of the locked or unlocked condition of the door 12.

The electric door strike according to the present invention utilizes an existing commercial product known as an electric strike. If you have been "buzzed-in" to a friend's apartment, or used a 'key-card' to access your office, you have probably used an electric strike. A typical electric strike system consists of two components: 1) an electrically actuated latch in a door frame which is momentarily 'triggered' by a remote device, to permit opening of a door; and 2) the remote device that actuates the electric strike (This device may be a push-button, card reader, timer, keypad or a key-fob transmitter).

The 'hands-free' aspect of the invention described herein is due to an anomaly of residential home design, which is that residential doors open into the building, as opposed to commercial doors, which push out. Hence, a locked residential door associated with an electric strike can be pushed open without touching the door handle.

The electric door strike according to the present invention and as described herein differs from commercial electric strikes in five ways: installation, wiring, keeper release arrangement, lateral adjustment, and remote control circuitry.

Installation

Residential building codes call for pre-hung exterior doors to be leveled and plumbed in an oversized double 2"×4" stud frame. This method provides for proper door alignment but creates a ¼" to ½" gap between the pre-hung frame and the surrounding studs. Since traditional electric strikes are surface mounted, i.e., screws through the strike plate are driven into the door frame, the installer is faced with a two choices:

1. Screw the strike plate to the door frame, which obviously has no structural integrity. The advantage of this option is that since there is nothing substantial to screw into, the installer can use small "dress screws" which typically will show in the finished installation; or
2. Use large "lag screws" to attach the strike plate cover to the underlying studs (drilled through the pre-hung frame). The advantage to this option is an obvious improvement in structural integrity. The disadvantage however, is that when the screws are tightened, the pre-hung frame will necessarily distort into the shim gap. When this happens, the lag screws are typically left untightened with the hope that no one will notice. A second disadvantage to this option is that, as mentioned above, the lag screws will show in the finished installation.

Through the use of an installation jig described below, the rectangular shaped electric door strike according to the present invention and as described herein, is actually embedded through the door frame and into the underlying studs. Proper depth of the jig-routed hole ensures that the rectangular strike cover is flush with the door frame, but is not attached to it. Also, since the rectangular strike is equipped with a decorative cover over the strike frame, the mounting screws will not show. The only screw heads visible in the finished product will be the small decorative cover screws.

Installation of a traditional electric strike in a wood door-jamb requires approximately four hours of installation time by a carpenter. By utilizing the installation jig described herein, the rectangular electric door strike described below may be installed in less than ten minutes with one routed hole—no finish work required.

Wiring Space

Traditional electric strikes have no space provision for wire lugs or splices. Typically the installer will enlarge the chiseled hole beneath the electric strike to provide a "make-shift" splice box. This enlarged hole further compromises the structural integrity of the installation. The rectangular electric door strike described below provides a "splice box" in the lock frame. As many as four twist-on wire connectors may be accommodated in the splice box after the strike has been installed. Also, the slice box may be accessed without removing the strike.

Keeper Release Arrangement

Latch keepers in traditional strikes are released (unlocked) by either of two methods:

1. a solenoid pushes or pulls a release apparatus to momentarily allow the keeper to be rotated, thus allowing the door to be pushed open by the user; or
2. an electromagnet acts directly on a release apparatus to momentarily allow the keeper to be rotated.

A traditional keeper release apparatus may have as many as eight parts (as in the U.S. Pat. No. 3,819,215 to Fuss).

Although the present invention is of the first (solenoid) type, it differs from the traditional method by using the solenoid plunger as the keeper release apparatus, resulting in only one moving part.

Lateral Adjustment Methodology

Traditional electric strikes employ two lateral adjustment methods:

1. The Sliding Keeper Support Method (example: the U.S. Pat. No. 4,867,496to Jay). This method attaches the keeper support body to the striker body with two screws. By loosening the screws, the keeper may be relocated along a slot in the striker body to a more advantageous location.

Advantages:

a. good structural integrity due to the use of large (#10) screws and nuts; and
b. the adjustment hardware is hidden in the finished installation.

Disadvantages:

a. strike must be removed to perform adjustment; and
b. elaborate machining and casting of striker body to provide precision adjustment slot.

2. The Latch Adapting Element Method (example: the U.S. Pat. No. 5,511,839 to Fuss). This method attaches adapter plates of various thicknesses to the face of the keeper. By choosing the appropriate plate, the face of the keeper may be moved forward or backward to suit the installation.

Advantages:

a. easy to install and change in field. Adjustment may be made after strike has been installed.

Disadvantages:

a. poor structural integrity due to use of small (#4) screws; and
b. adjustment hardware shows in the finished installation.

The rectangular electric door strike described below incorporates a combination of the two traditional methods. It uses a series of 1/16" thick shims to increase or decrease the distance between the keeper device and the striker body. By altering the number of shims, the keeper may be moved forward or back to suit field conditions.

Advantages:

a. shims are inexpensive;
b. no special machining or casting required to use shims;
c. structural integrity is better than any existing method; and
d. adjustment hardware is hidden in the finished installation.

Disadvantages:

a. strike must be removed to perform adjustment.

Remote Control Circuitry

As indicated in an earlier section, it is advantageous to mate an electric strike to a remote control device. Early methods involved "hard-wiring" of the circuitry, but modern RF technology has made it possible to control door access with a simple "key-fob" remote. The method selected to control the rectangular electric door strike described below incorporates a commercially available RF transmitter and receiver, built into a simple timer control circuit. This unique arrangement will accomplish several objectives:

1. The user may see the status of the striker from a distance (example: inside a car in the user's garage) through the use of an LED mounted in the exterior door frame of the house.
2. A timer circuit will energized the striker for 90 seconds, which will allow the user time to gather packages and get through the unlatched door.
3. The timer will reset the striker to the de-energized (locked) position at the end of 90seconds. This feature will allow the user to "forget" to lock the door behind him.
4. The timer's 90 second maximum duration allows any solenoid or coil to be utilized without maintenance repercussions.
5. The "timer interrupt" function described herein allows the user to terminate the time delay and lock the strike immediately if required.

Figure 3:
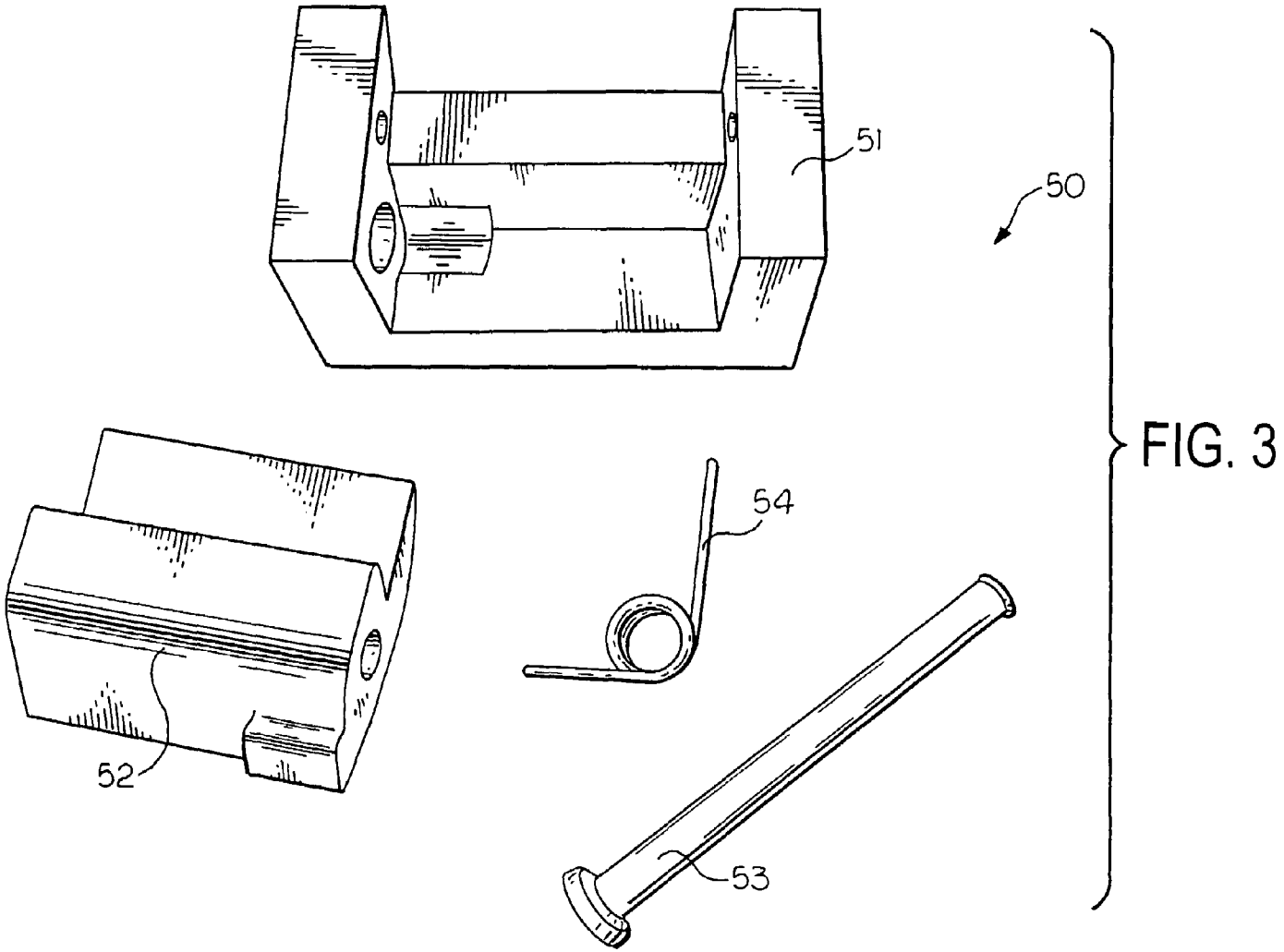
FIG. 3 is an exploded perspective view of a keeper device according to the present invention.

There is shown in FIG. 3 a keeper device 50 according to the present invention. A generally C-shaped keeper support body 51 rotatably retains a keeper 52 on a keeper shaft 53 extending between arms of the body 51. A spring 54 also is retained on the shaft 53 and biases the keeper 52 to a locked (door latched) position for retaining a bolt or plunger (not shown) extending from the edge of a door.

Figure 4:
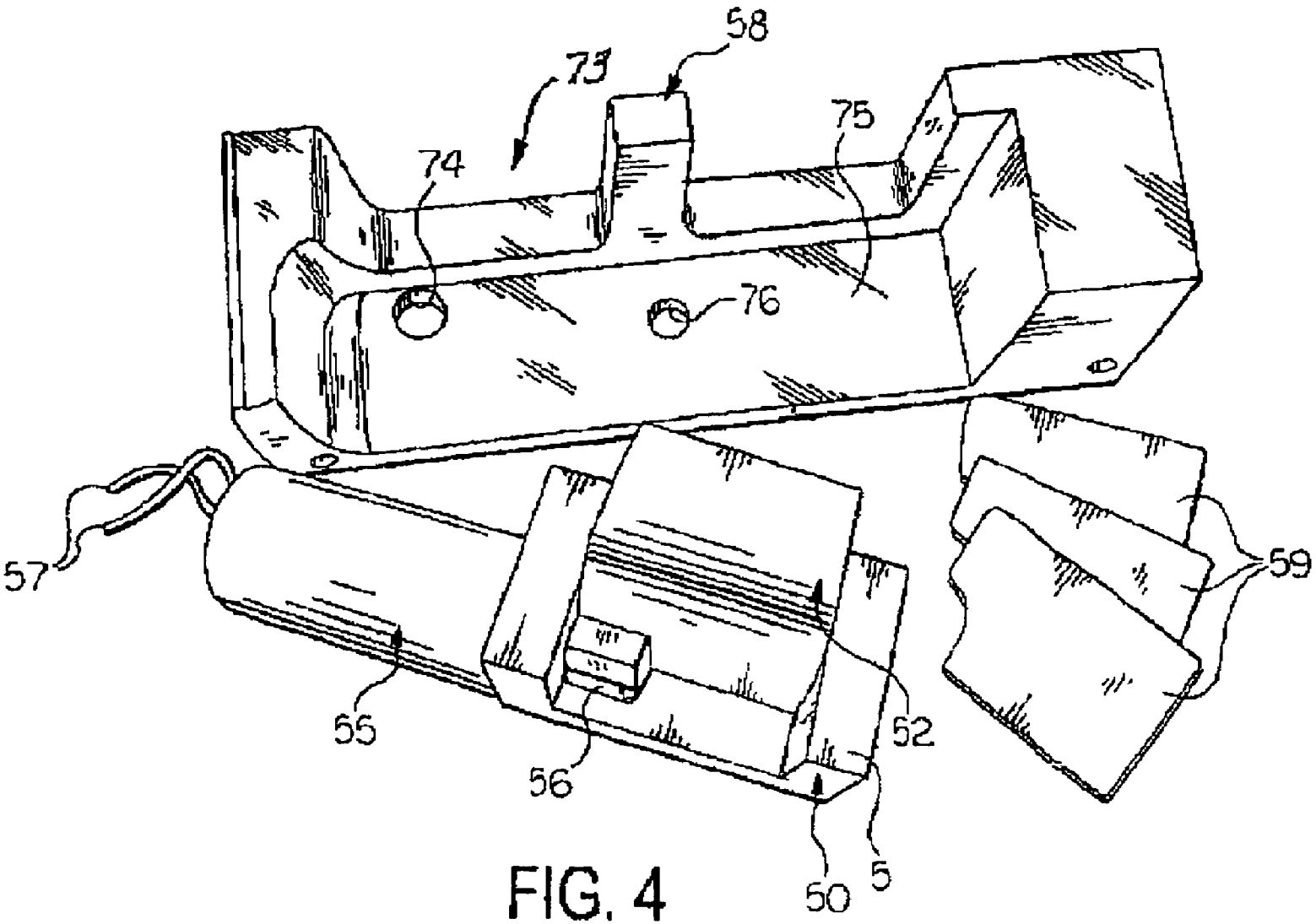
FIG. 4 is an exploded view of a striker device according to the present invention with the keeper device shown in FIG. 3 assembled.
Figure 5:
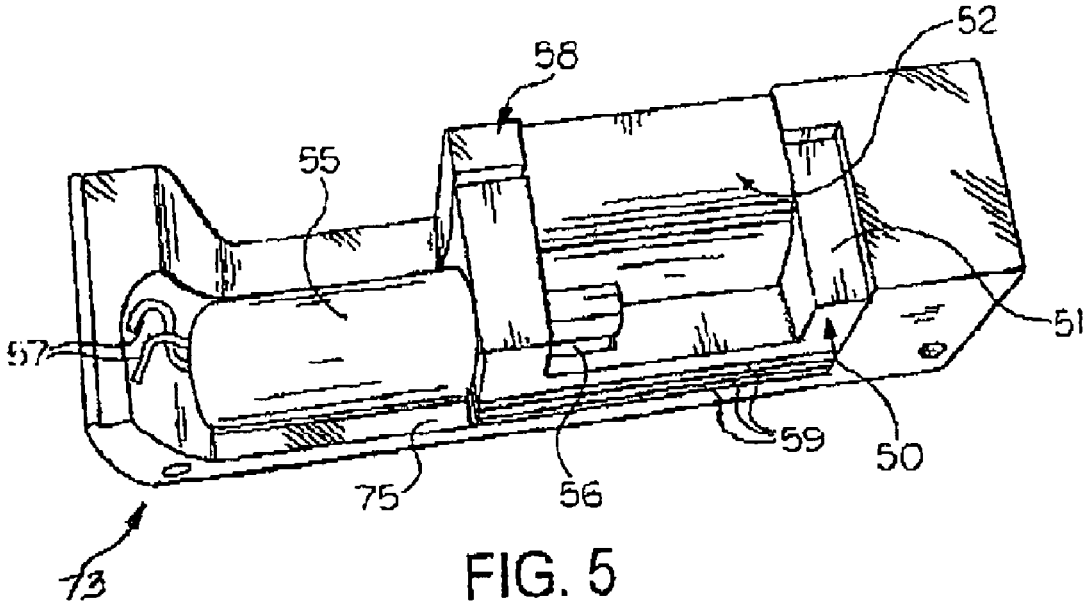
FIG. 5 is an enlarged perspective view of the striker device shown in FIG. 4 assembled.
Figure 6:
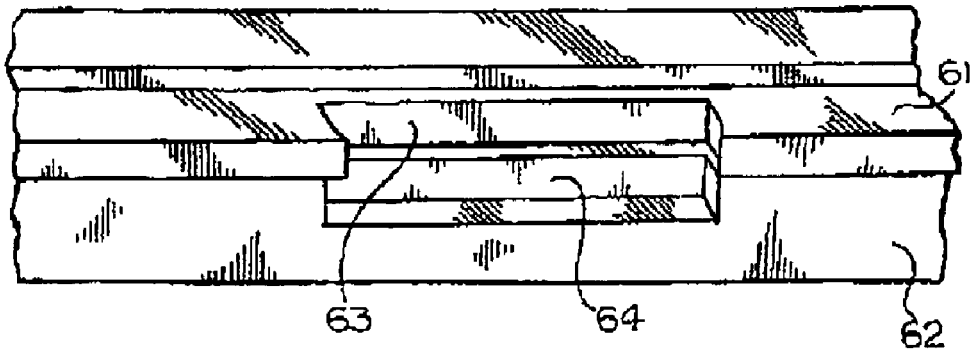
FIG. 6 is a perspective view of a door frame and supporting stud modified in accordance with the present invention to receive the striker device shown in FIG. 5.

FIG. 4 shows the keeper device 50 assembled for use and a solenoid device 55 having a retractable plunger 56 and wires 57 for connection to a source of electrical power. The keeper device 50 and the solenoid device 55 are assembled together ready to be installed in a striker body 58 with a plurality of shims 59. The plunger 56 prevents rotation of the keeper 52 to maintain a locked condition (door latched position). The solenoid device 55 is operated by applying electrical power to the wires 57 to retract the plunger 56 thereby permitting the keeper 52 to move to a door unlatched position against the force applied by the spring 54. In FIG. 5, the keeper device 50, the solenoid device 55 and the striker body 58 are shown assembled together with the shims 59 as a striker device 60. The shims 59 can be approximately 1/16 inch thick with a selected number of shims determining the spacing required to position the keeper device 50 relative to a wall 75 of the striker body 58 and in alignment with a cooperating latch on a door mounted in a door frame 61 (FIG. 6). Alternatively, the shims 59 can be of different thickness and selected accordingly to determine the spacing.

Figure 7:
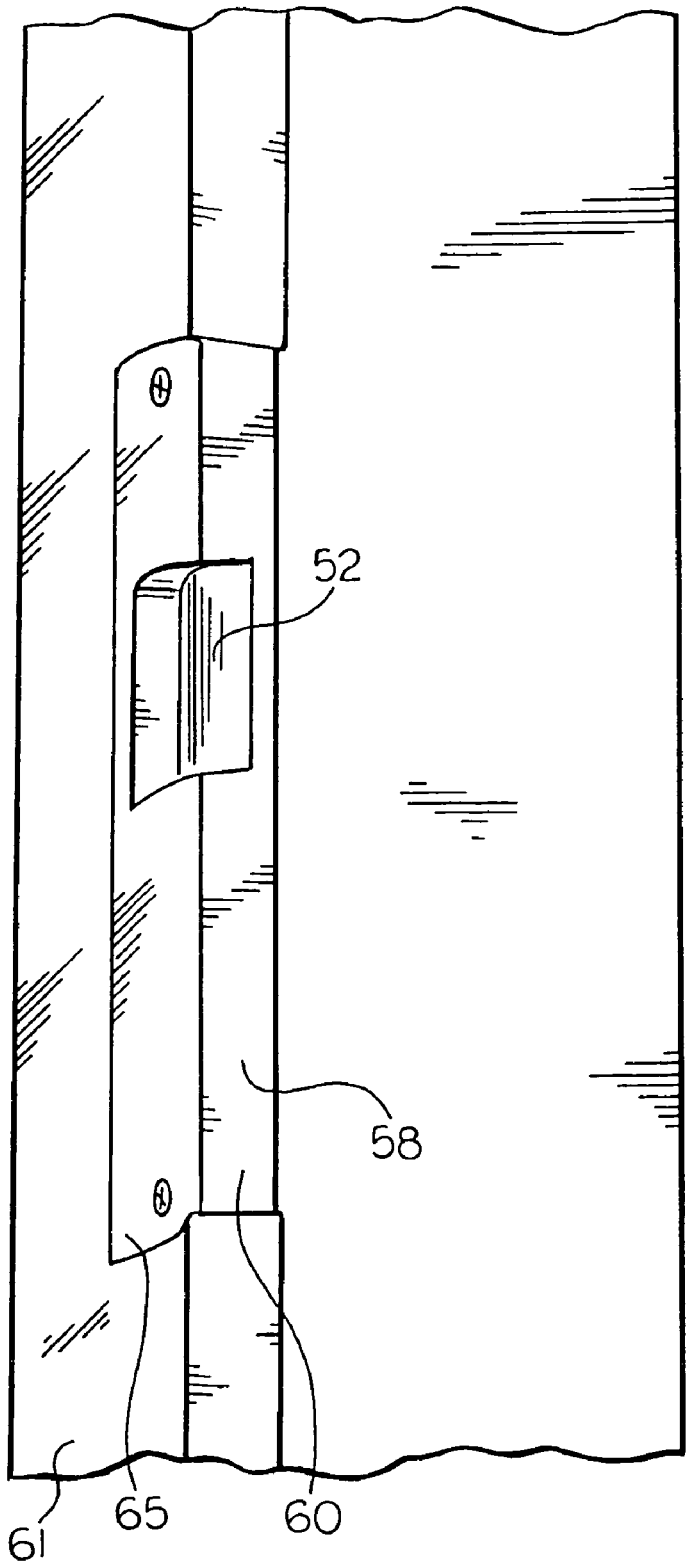
FIG. 7 is a perspective view of the striker device shown in FIG. 5 mounted in the door frame shown in FIG. 6 with a faceplate.

A portion of a typical door frame 61 is shown in FIG. 6 attached to a wooden stud 62. In accordance with the present invention, the door frame 61 has been modified by forming an aperture 63 therethrough open at one edge of the door frame. A cavity 64 is formed in the stud 62 aligned with the aperture 63 and open at the same edge. FIG. 7 shows the striker device 60 mounted in the door frame 61 and the stud 62 (not shown) with a faceplate 65 attached to the striker body 58.

Figure 8:
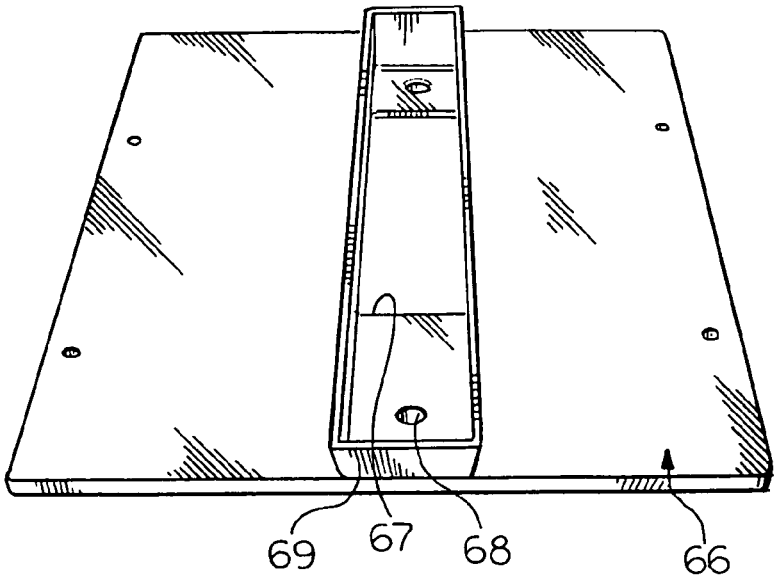
FIG. 8 is a rear view of a template according to the present invention.
Figure 9:
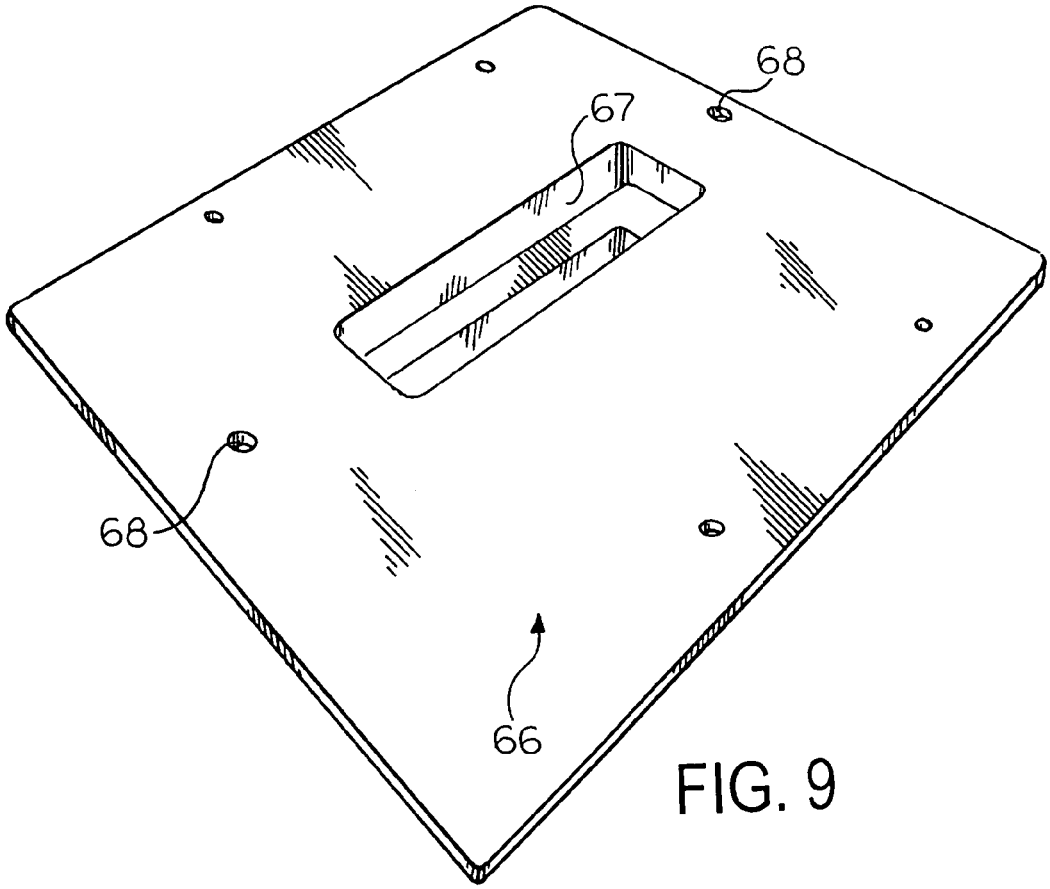
FIG. 9 is a front view of the template shown in FIG. 8.
Figure 10:
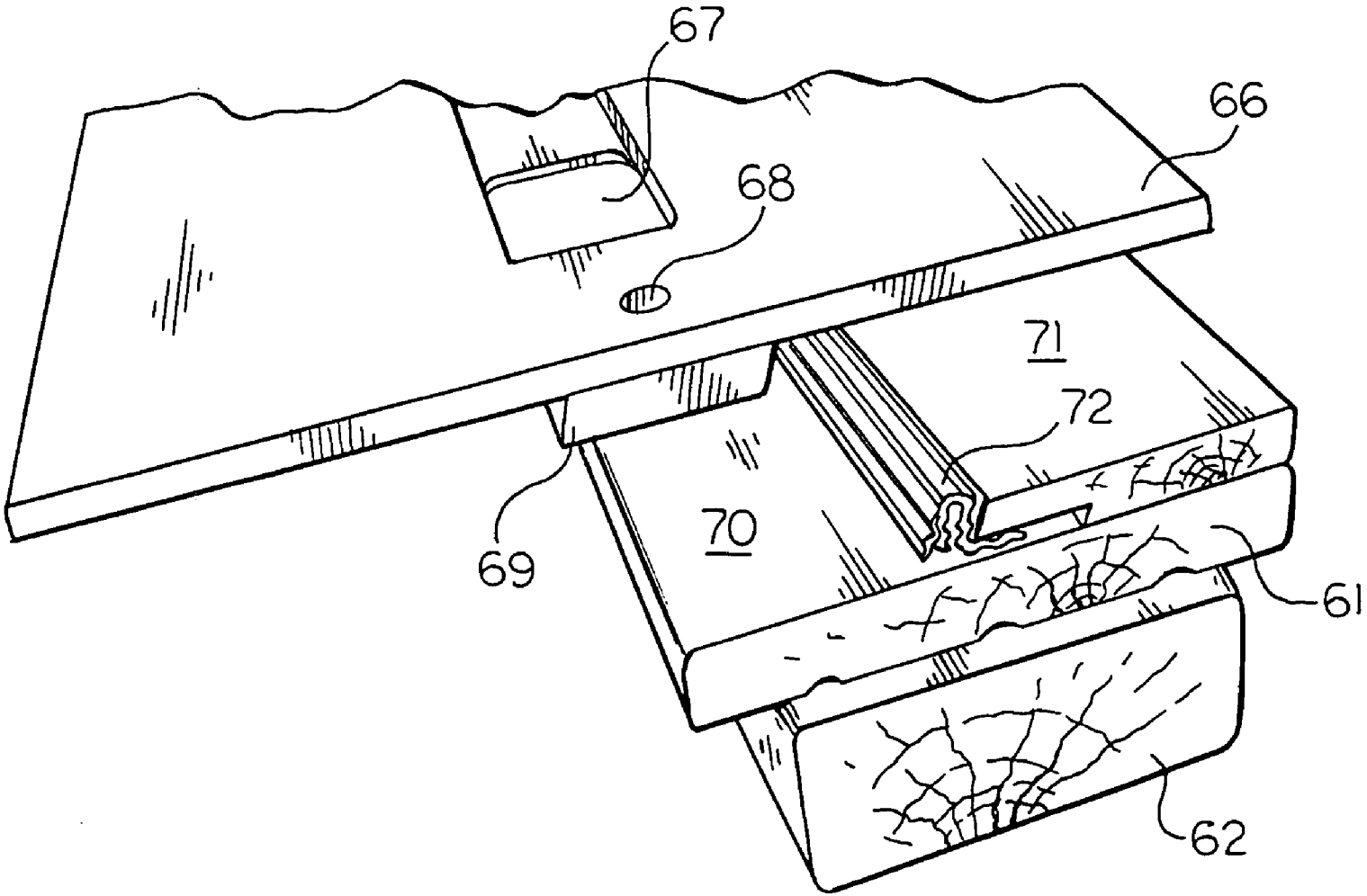
FIG. 10 is a perspective view of the template shown in FIGS. 8 and 9 attached to the door frame.
Figure 11:
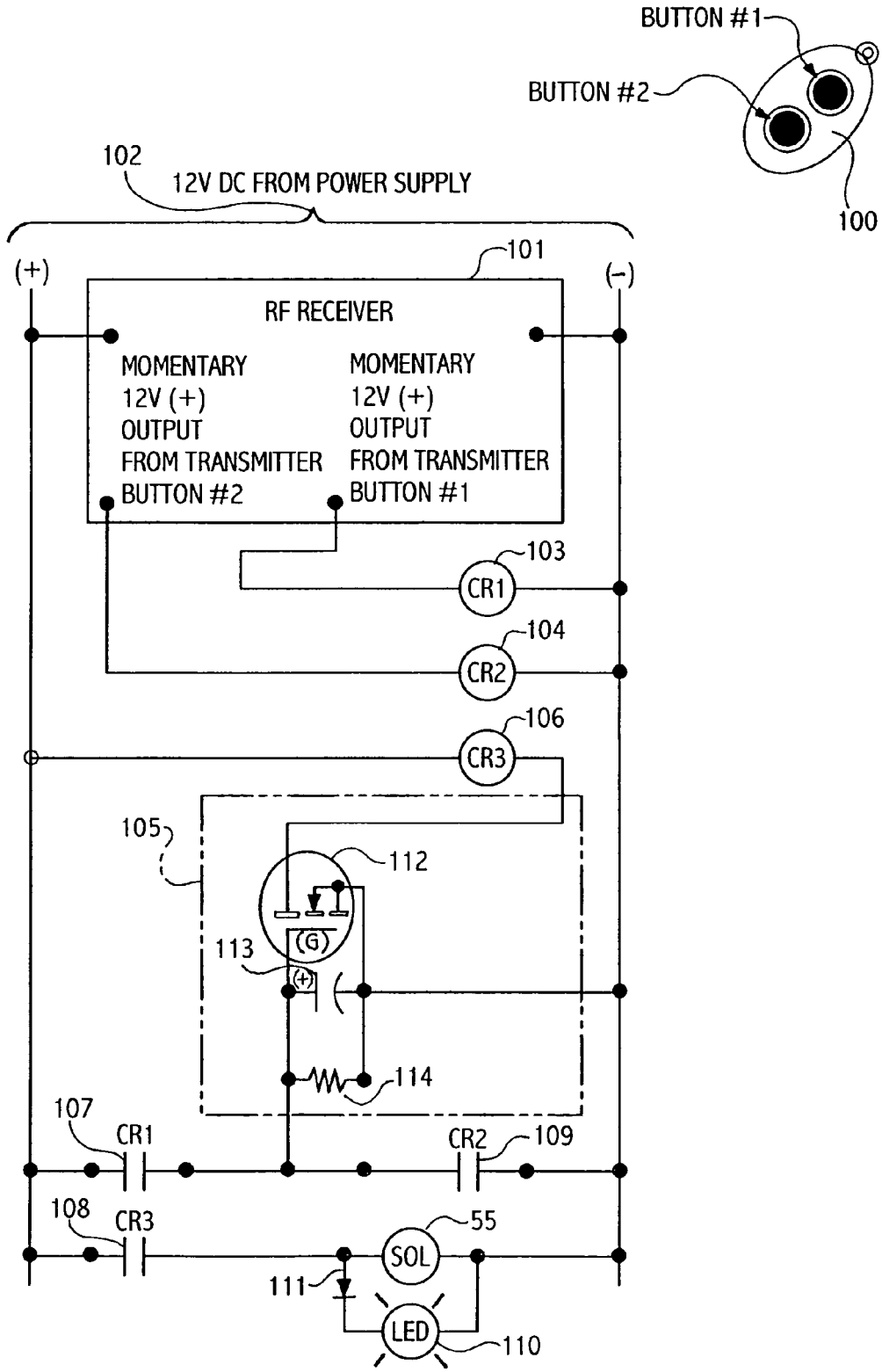
FIG. 11 is a schematic diagram of the control circuit according to the present invention.
Figure 12:
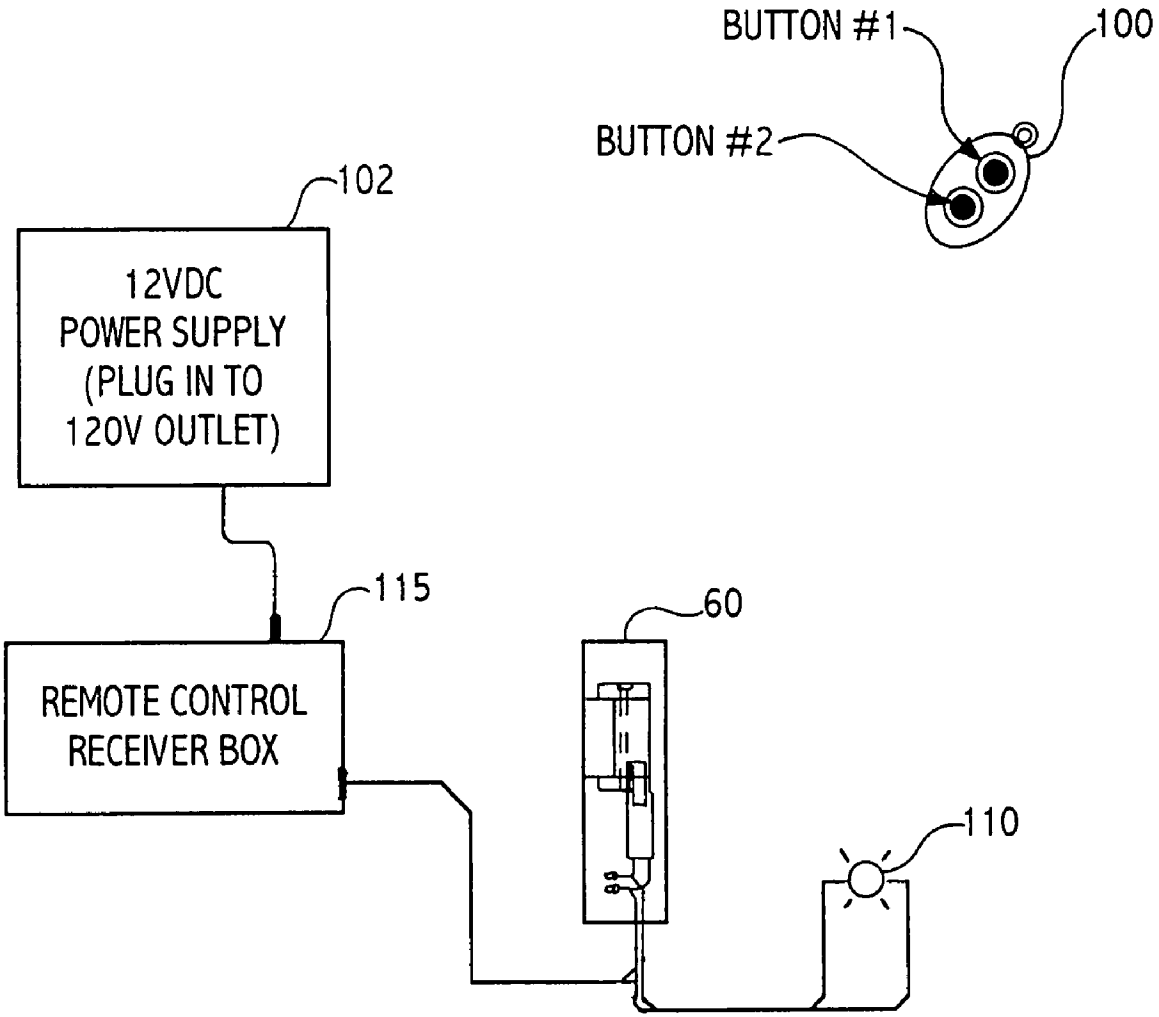
FIG. 12 is a block diagram of the control circuit according to the present invention.

FIG. 8 is a rear view and FIG. 9 is a front view of a jig in the form of a generally planar template 66 used to form the aperture 63 and the cavity 64. The template 66 has a central aperture 67 formed therein to guide a router tool (not shown). The template 66 is attached to a door frame by a pair of fasteners (not shown) extending through a pair of fastener apertures 68 formed in the template. A wall 69 extends from a rear surface of the template 66 and surrounds the central aperture 67. As shown in FIG. 10, the wall 69 rests on a recessed surface 70 of the door frame 61 to permit the planar body of the template 66 to extend over an outer surface 71 of the door frame and a weather-strip 72. Referring to FIG. 5, the striker body 58 provides a splice box 73 to accommodate twist-on wire connectors (not shown) used to connect wires such as the wires 57 to a power source, a switch and a remote control receiver as shown in FIGS. 11 and 12. The splice box 73 is accessible after the striker body 58 is mounted in the aperture 63 and the cavity 64. Wiring can be brought into the splice box 73 through a wiring aperture 74 (FIGS. 4 and 5) formed in the wall 75 of the striker body 58. Also, one or more mounting apertures 76 (FIG. 4) can be formed in the wall 75 for receiving threaded fasteners (not shown) that bolt into the keeper device 50 (FIG. 5). It is also intended that lag-bolts be extended through twin apertures in the perimeter of the striker body 58 to securly bolt the striker body 58 to the underlying stud 62 (FIG. 6).

There is shown in FIG. 11 a schematic diagram of a control circuit to energize or de-energize the electric door strike according to the present invention and as described herein. A remote control can be in the form of a transmitter 100 and receiver 101 set such as a General Security International Corp. Model KE-12 or equivalent. 12VDC power is supplied to the RF receiver 101 by a commercially available 12V DC power supply 102. Two wires extend from the RF receiver 101 to provide 12VDC (+) to associated relay coils CR1 103 and relay coil CR2 104. These relay coils are energized momentarily through the actuation of buttons #1 and #2 of the RF "key-fob" transmitter 100. When a CRI NO contact 107 closes because the CR1 relay coil 103 is energized, a timer circuit 105 energizes a relay coil CR3 106 for ninety seconds. This causes a CR3 NO contact 108 to close and energize the electric strike solenoid 55 and an LED indication lamp 110 connected in parallel. A diode 111 is placed in the LED loop to preclude "back-feeding" of the solenoid 55 by unauthorized personnel. When the relay coil CR2 104 is energized by actuation of the RF transmitter 100 button #2, the time delay circuit is interrupted and the relay coil CR3 106 is de-energized. This causes the CR3 NO contact 108 to open and de-energize the electric strike solenoid 55 and the LED indication lamp 110. The time delay circuit 105 includes a MOSFET 112, a capacitor 113 and a resistor 114. The duration of the time delay may be varied by altering the values of the resistor 114 and the capacitor 113. All of the above referenced components except the power supply are housed in a control box 115 (FIG. 12).

There is shown in FIG. 12 a block diagram of the present invention as described above. The 12VDC power supply 102 supplies power to the control box 115. Actuation of the #1 and #2 buttons on the RF transmitter 100 causes radio control signals to direct the striker device 60 and the LED indication lamp 110 to be energized and de-energized respectively.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An electric door strike for use with an inwardly opening door mounted in a door frame comprising:

a striker body for mounting in an aperture formed in a door frame and a cavity formed in, an underlying stud, said striker body having a keeper mounting portion and a splice box portion;

a keeper device mounted in said striker body keeper mounting portion, said keeper device including a keeper support body rotatably retaining therein a keeper biased by a return spring to a door latched position, said keeper being selectively movable to a door unlatched position against a biasing force applied by said return spring;

a solenoid device mounted on an external surface of said keeper support body in said striker body splice box portion, said solenoid device having a plunger normally blocking said keeper and preventing movement of said keeper from the door latched position, said solenoid being selectively operable for moving said plunger away from said keeper thereby permitting movement of said keeper to the door unlatched position;

a control circuit mounted in said striker body and connected to said solenoid device, said control circuit including a radio signal receiver being responsive to a firs transmitted signal to cause said control circuit to actuate said solenoid device to move said plunger away from said keeper, said control circuit including a time delay circuit connected to said solenoid device for actuating said solenoid device for a predetermined delay time period and wherein said time delay circuit interrupts said predetermined delay time period in response to a second transmitted signal received by said receiver;

at least one shim positioned between said keeper device and a wall of said striker body to align said keeper with a cooperating latch on a door mounted in the door frame when said striker body is mounted in the door frame; and a splice box accessible from outside said striker body when said striker body is mounted on the underlying stud, said splice box comprising at least one wiring aperture supporting the wiring of said control circuit, said splice box being formed by said splice box portion and said external surface of said keeper support body.

2. The door strike according to claim 1 including a pivot shaft pivotally mounting said keeper for movement between the door latched position and the door unlatched position.

3. The door strike according to claim 1 including a selected number of approximately 1/16 inch thick shims positioned between said keeper device and a wall of said striker body to align said keeper with a cooperating latch on a door mounted in the door frame when said striker body is mounted in the door frame.

4. The door strike according to claim 1 including at least one mounting aperture formed in a wall of said striker body for fastening said striker body to the stud.

5. The door strike according to claim 1 including:

a wail of said striker body having at least one mounting aperture fanned therein for receiving a fastener for attachment to the stud;

said keeper being pivotally mounted in said striker body on a pivot shaft; and a remote radio signal transmitter for generating said first and second transmitted signals.

6. he door strike according to claim 5 including an LED mounted on said striker body and being connected to said control circuit, said control circuit lighting said LED when said plunger is moved away from said keeper.

7. An electric door strike for use with an inwardly opening door mounted in a door frame comprising:

a striker body mountable on an underlying stud through a door frame and within a cavity formed in the underlying stud, said striker body having a keeper mounting portion and a splice box portion;

a keeper device mounted in said striker body keeper mounting portion, said keeper device including a keeper support body rotatably retaining therein a keeper biased by a return spring to a door latched position, said keeper being selectively movable to a door unlatched position against a biasing force applied by said return spring;

at least one shim positioned between said keeper device and a wall of said striker body to align said keeper with a cooperating latch on a door mounted in the door frame when said striker body is mounted in the door frame;

a solenoid device mounted on an external surface of said keeper support body in said striker body splice box portion, said solenoid device having a plunger normally blocking said keeper and preventing movement of said keeper from the door latched position, said solenoid being selectively operable for moving said plunger away from said keeper thereby permitting movement of said keeper to the door unlatched position;

a remote radio signal transmitter and associated receiver, said receiver being included in a control circuit mounted in said striker body and connected Lo said solenoid device, said receiver being responsive to operation of said transmitter to cause said control circuit to actuate said solenoid device to move said plunger away from said keeper; and a time delay circuit in said control circuit connected to said solenoid device for actuating said solenoid device for a predetermined delay time period wherein said transmitter is operable to control said time delay circuit to interrupt said predetermined delay time period.

8. The door strike according to claim 7 wherein said transmitter includes a first button operable to actuate said time delay circuit and a second button operable to interrupt said predetermined delay time period.

9. The door strike according to claim 8 including an LED mounted on said striker body and being connected to said time delay circuit, said time delay circuit lighting said LED when said plunger is moved away from said keeper.

10. An electric door strike for use wit an inwardly opening door mourned in a door frame comprising:

a striker body mountable on an underlying stud through a door frame and a within a cavity formed in an underlying stud, said striker body having a keeper mounting portion and a splice box portion;

a keeper device mounted in said striker body keeper mounting portion, said keeper device including a keeper support body rotatably retaining therein a keeper biased by a return spring to a door latched position, said keeper being selectively movable to a door unlatched position against a biasing force applied by said return spring;

at least one shim positioned between said keeper device and a wall of said striker body to align said keeper with a cooperating latch on a door mounted in the door frame when said striker body is mounted in the door frame;

a solenoid device mounted on an external suffice of said keeper support body in said striker body splice box portion, said solenoid device having a plunger normally blocking said keeper and preventing movement of said keeper from the door latched position, said solenoid being selectively operable for moving said plunger away from said keeper thereby permitting movement of said keeper to the door unlatched position;

a remote radio signal transmitter and associated receiver, said receiver being included in a control circuit mounted in said striker body and connected to said solenoid device, said receiver being responsive to operation of said transmitter to cause said control circuit to actuate said solenoid device to move said plunger away from said keeper;

a time delay circuit in said control circuit connected to said solenoid device for actuating said solenoid device for a predetermined delay time period wherein said transmitter is operable to control said time delay circuit to interrupt said predetermined delay time period; and a splice box accessible from outside said striker body when said striker body is mounted on the underlying stud, said splice box comprising at least one wiring aperture supporting the wiring of said control circuit, said splice box being formed by said splice box portion and said external surface of said keeper support body.

11. The door strike according to claim 10, the control circuit further comprising a radio signal receiver being responsive to a first transmitted signal to cause said control circuit to actuate said solenoid device to move said plunger away from said keeper, said control circuit including a time delay circuit connected to said solenoid device for actuating said solenoid device for a predetermined delay time period and wherein said tine delay circuit interrupts said predetermined delay time period in response to a second transmitted signal received by said receiver.

12. The door strike according to claim 10 including a pivot shaft pivotally mounting said keeper for movement between the door latched position and the door unlatched position.

13. The door strike according to claim 10 including a selected number of approximately 1/16 inch thick shims positioned between said keeper device and a wall of said striker body to align said keeper with a cooperating latch on a door mounted in the door frame when said striker body is mounted in the door frame.

* * * * *